US006302786B1

(12) United States Patent
Bauer et al.

(10) Patent No.: US 6,302,786 B1
(45) Date of Patent: Oct. 16, 2001

(54) VENTED CABINET

(75) Inventors: Thomas E. Bauer, Saginaw; Michael R. Lee, Freeland, both of MI (US)

(73) Assignee: Case Systems, Inc., Midland, MI (US)

( * ) Notice: Subject to any disclaimer, the term of this patent is extended or adjusted under 35 U.S.C. 154(b) by 0 days.

(21) Appl. No.: 09/515,679

(22) Filed: Feb. 29, 2000

(51) Int. Cl.[7] ..... F24F 7/00

(52) U.S. Cl. ..... 454/339; 454/49; 454/56; 312/209

(58) Field of Search ..... 454/49, 56, 339; 312/209

(56) References Cited

U.S. PATENT DOCUMENTS

| | | | | |
|---|---|---|---|---|
| 150,219 | * | 4/1874 | Babcock | 454/239 |
| 480,718 | * | 8/1892 | Ennis | 454/239 |
| 1,445,975 | * | 2/1923 | Salmon, Jr. | 454/239 |
| 2,701,746 | * | 2/1955 | Piggott | 454/239 |
| 3,049,069 | * | 8/1962 | Whiston et al. | 454/239 |
| 4,100,847 | | 7/1978 | Norton . | |
| 4,550,650 | | 11/1985 | Denner et al. . | |
| 4,616,562 | | 10/1986 | Kuechler . | |
| 4,753,496 | | 6/1988 | Bussard . | |
| 5,052,569 | * | 10/1991 | Cooper | 220/1.5 |
| 5,056,422 | | 10/1991 | Horntvedt . | |
| 5,213,059 | * | 5/1993 | Krantz | 119/15 |
| 5,407,389 | | 4/1995 | Poblete et al. . | |
| 5,779,537 | * | 7/1998 | Alden | 454/239 |
| 5,851,143 | | 12/1998 | Hamid . | |
| 5,924,921 | * | 7/1999 | Yang | 454/253 |
| 5,944,602 | | 8/1999 | Grundy . | |
| 5,964,659 | | 10/1999 | Hertzler et al. . | |

* cited by examiner

*Primary Examiner*—Harold Joyce
*Assistant Examiner*—Derek S. Boles
(74) *Attorney, Agent, or Firm*—Price, Heneveld, Cooper, DeWitt & Litton

(57) ABSTRACT

A vented laboratory cabinet from which vapors and fumes may be effectively exhausted from all parts of the cabinet includes an interior storage space defined by a plurality of panels that are accessible through a closeable door, at least one shelf carried within the cabinet interior, and a vent pipe extending downwardly from an exhaust opening toward a lower part of the cabinet. Improved venting is achieved with a vent pipe having at least two vertically spaced apart vent openings for passage of gases from the cabinet into the vent pipe, wherein at least one of the vent openings is located above the shelf and at least one other vent opening is located below the shelf. The improved vented laboratory cabinet provides effective evacuation of fumes from both sides of the shelf, whereby accumulation of chemical vapors is reduced or eliminated.

24 Claims, 2 Drawing Sheets

VENTED CABINET

BACKGROUND OF THE INVENTION

1. Field of the Invention

This invention relates to laboratory furniture, and more particularly to a vented laboratory cabinet.

2. Technical Background

Because stored solvents and the like can sometimes escape from their containers and release noxious, corrosive, flammable, explosive or even potentially poisonous vapors, it is desirable to store solvents and other chemicals that are capable of volatilizing into the atmosphere in a vented cabinet. Such vented cabinets have typically included an outlet port that is connected to a vacuum exhaust system that carries chemical vapors from the cabinet and out of the laboratory to prevent accumulation of volatile gasses or fumes in the cabinet. The conventional vented laboratory cabinets typically include a single exhaust outlet opening that is located near the top of the cabinet, usually either on a top panel or a back panel of the cabinet.

A problem with conventional vented laboratory cabinets for storing volatile materials that can potentially escape from their containers in the form of a vapor is that the vapors formed in the cabinet are not always effectively exhausted. For example, a vapor can sometimes accumulate within the lower or middle zones of a conventional vented laboratory cabinet having an exhaust opening at or near the top of the cabinet. This can especially be a problem when fumes cannot easily flow around the shelves in the cabinet. Accordingly, there is a need for a vented laboratory cabinet that provides effective evacuation of fumes from all shelves in the cabinet from top to bottom.

Another disadvantage with commercially available vented laboratory cabinets is that they do not allow selective access to a particular shelf or to a particular part of the cabinet. Therefore, with such conventional cabinets, noxious fumes from any part of the cabinet or from any shelf in the cabinet can escape into the laboratory when the cabinet door is opened to store a chemical on or to remove a chemical from a different shelf or different part of the cabinet. Accordingly, it would be desirable to provide a vented laboratory cabinet which minimizes the possible escape of noxious fumes while the interior of the cabinet is being accessed.

SUMMARY OF THE INVENTION

The present invention provides a vented laboratory cabinet that overcomes the above-identified problems associated with conventional vented laboratory cabinets.

An aspect of the invention is directed to a vented laboratory cabinet in which vapors and fumes are effectively exhausted from all shelves or parts of the cabinet from top to bottom. More specifically, an article of laboratory furniture for storage of volatile chemicals is provided which includes a cabinet having an interior storage space accessible through a closeable door, a plurality of vertically spaced apart shelves carried within the cabinet interior; and a vent pipe extending downwardly from an exhaust opening near the top of the cabinet. The vent pipe includes at least two vertically spaced apart openings that allow passage of gasses from the cabinet into the vent pipe.

In accordance with another aspect of the invention, a vented laboratory cabinet is provided which allows limited or selective access to a particular shelf or shelves, or a particular part of the cabinet while not providing access to another shelf or shelves or another part of the cabinet. The vented laboratory cabinet in accordance with this aspect of the invention includes an interior storage space defined by a plurality of walls and a plurality of closeable doors. The cabinet also includes a plurality of vertically spaced apart shelves carried within the cabinet interior. The closeable doors are vertically spaced apart, with each door allowing access to at least one of the plurality of shelves, but not allowing access to at least one other of the plurality of shelves. These features in combination reduce the possibility of noxious fumes escaping from the cabinet while the interior of the cabinet is being accessed.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
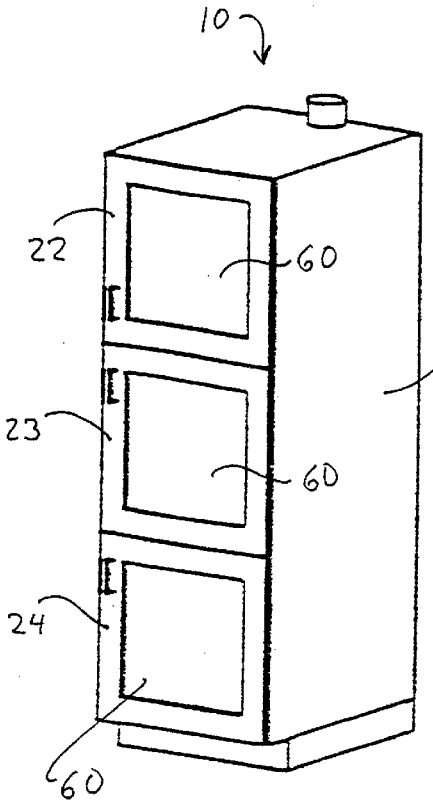
FIG. 1 is a perspective view of a vented laboratory cabinet employing the principles of this invention.
Figure 2:
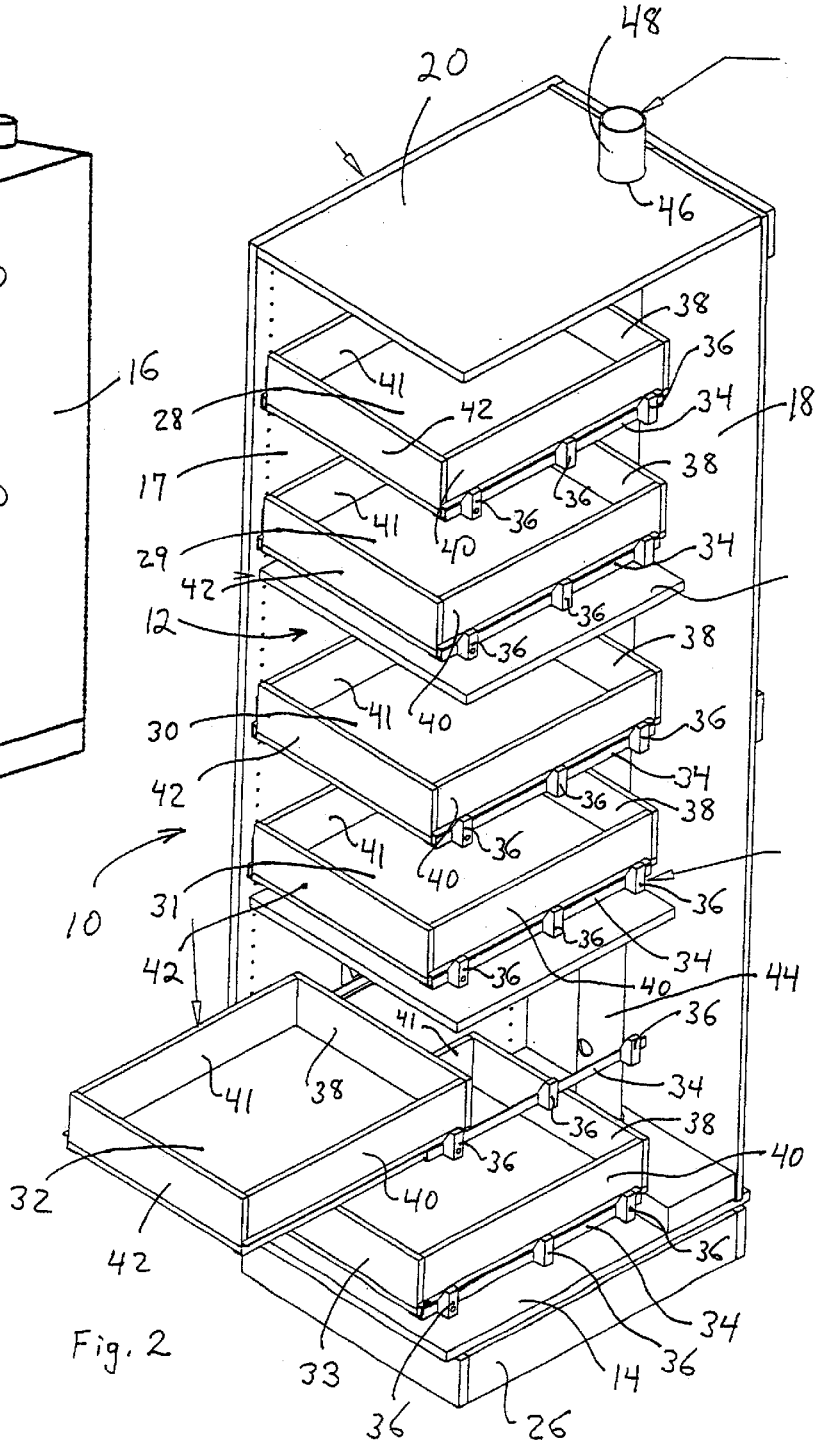
FIG. 2 is a perspective view of the vented laboratory cabinet shown in FIG. 1, with the front doors and a side panel removed to reveal details of the internal structure of the cabinet.

Shown in FIG. 1 is a vented laboratory cabinet 10 representing a particular embodiment of the invention. With reference to FIGS. 1 and 2, vented laboratory cabinet 10 includes a interior storage space 12 defined by a bottom panel 14, side panels 16 and 17, back panel 18, top panel 20, and doors 22, 23 and 24. Vented laboratory 10 may be mounted on a pedestal 26 to provide an appropriate spacing between lower door 24 and a base, such as a floor, on which vented laboratory 10 is positioned.

Vented laboratory cabinet 10 includes a plurality of vertically spaced apart shelves 28, 29, 30, 31, 32 and 33. In the illustrated embodiment, each of shelves 28–33 is slidably mounted in vented laboratory cabinet 10 on slide rails 34, which are supported by a plurality of slide spacer blocks 36. Suitable slide rails 34 are well known and commercially available. By slidably mounting shelves 28–33 on slide rails 34, shelves 28–33 can be pulled outwardly from the cabinet to allow easy access to items stored on the shelves. Spacer blocks 36 are spaced apart to allow air and any vapors or fumes in the air to flow easily around the sides of shelves 28–33, thereby providing for more efficient removal of vapors or fumes from between the shelves of vented laboratory cabinet 10. Each of shelves 28–33 includes a rear lip 38, side lips 40 and 41, and front lip 42 which together circumscribe the periphery of each shelf to prevent items from falling off the shelf, especially when the shelf is slid outwardly from vented laboratory cabinet 10 or inwardly into vented laboratory cabinet 10.

Figure 3:
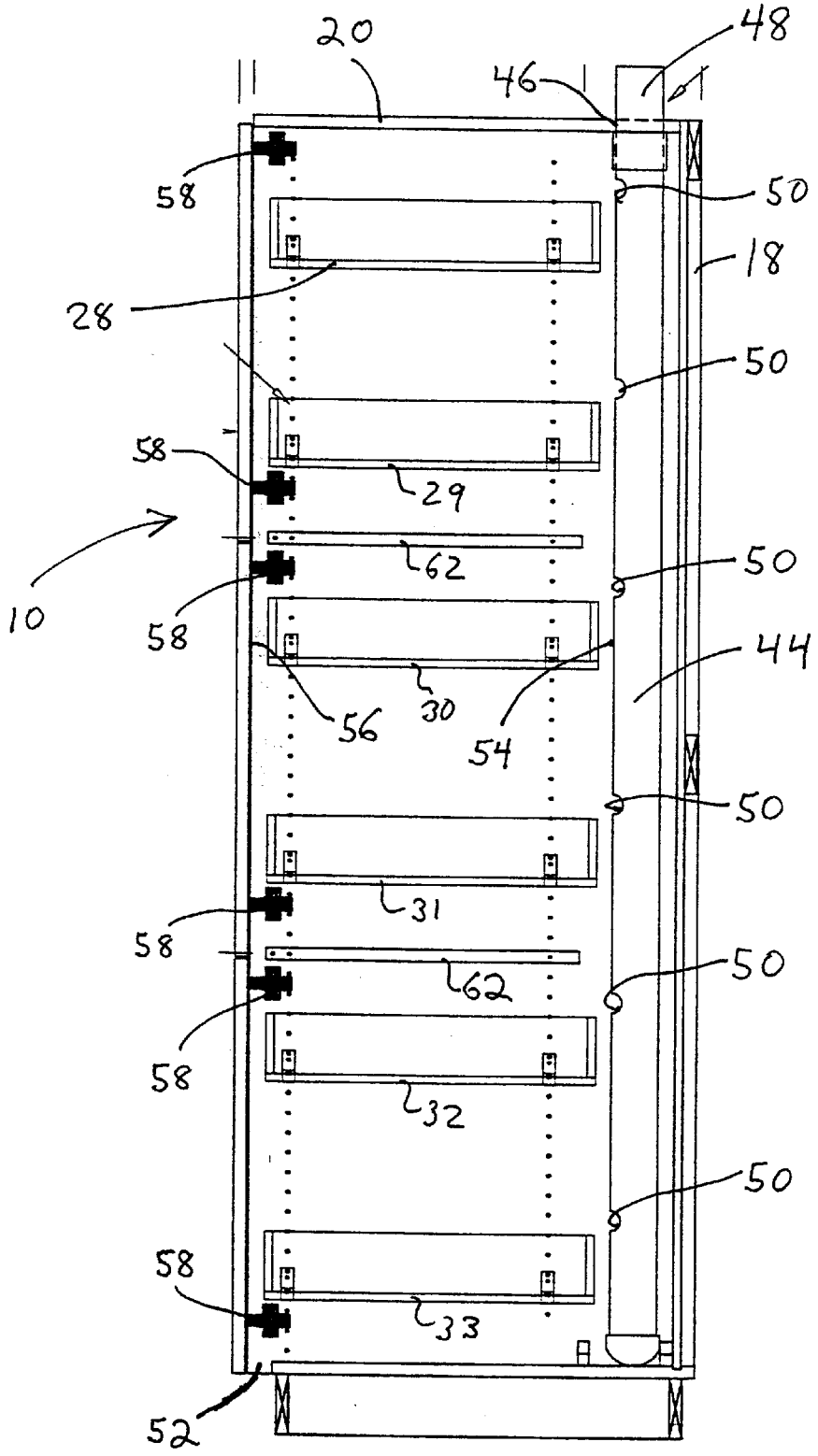
FIG. 3 is a side elevational view of the vented laboratory cabinet shown in FIGS. 1 and 2, with the side panel removed as shown in FIG. 2 to allow a view of the interior of the cabinet.

As shown in FIGS. 2 and 3, vented laboratory cabinet 10 includes a vent pipe 44 that extends from an exhaust opening 46 at or near the top of vented laboratory cabinet 10 downwardly toward the bottom of vented laboratory cabinet 10. In the illustrated embodiment exhaust opening 46 is defined near the rearward edge of top panel 20. However, as an alternative, exhaust opening 46 may be located through back panel 18, in which case vent pipe 44 would extend horizontally from back panel 18, bend downwardly sharply, such as at a 90 degree angle, and extend downwardly adjacent the back panel 18. Desirably, a sealing fit is provided between vent pipe 44 and exhaust opening 46 to prevent fumes from escaping through any space between the outer surface of vent pipe 44 and the inner surface of exhaust opening 46. A part 48 of vent pipe 44 extends upwardly through exhaust opening 46 and upwardly away from top panel 20. Part 48 of vent pipe 44 is connected to an exhaust system (not shown) as is known in the art.

In order to provide more efficient ventilation and to more effectively exhaust vapors or fumes from various parts of vented laboratory cabinet 10, vent pipe 44 is provided with a plurality of vent openings 50. Preferably, as shown in FIG. 3, a vent opening 50 is associated with a space defined above each of the shelves 28–33.

Air can be allowed to enter the cabinet through circumferential leakages at the doors of the cabinet. Alternatively, an air inlet opening 52 may be provided at the bottom of vented laboratory cabinet 10. As another alternative, air may be allowed to enter the cabinet through both circumferential leakages around the periphery of the doors and through a separately provided air inlet opening, such as air inlet opening 52.

As best illustrated in FIG. 3, shelves 28–33 have a depth that is less than the distance from a front surface 54 of vent pipe 44 to an interior surface 56 of doors 22–24, to provide a gap between each of shelves 28–33 and vent pipe 44, and a gap between each of shelves 28–33 and a respective one of the doors 22–24. These gaps allow air, along with fumes and vapors, to freely flow around the front and rear of shelves 28–33, thereby providing more efficient ventilation of vented laboratory cabinet 10. The term "gases" as used herein is meant to encompass air and other gases, fumes and vapors.

As illustrated in FIGS. 1 and 2, vented laboratory cabinet 10 includes three separately closeable doors, including an upper door 22, a middle door 23, and a lower door 24. Doors 22–24 are pivotably hinged to side panel 17 by hinges 58 (FIG. 3). An advantage of providing a plurality of separately closeable doors on vented laboratory cabinet 10 is that it is possible to reduce the escape of noxious fumes or vapors from vented laboratory cabinet 10 when one of the doors 22–24 is opened. For example, when a particularly noxious substance is stored on one of the upper two shelves 28 or 29 associated with upper door 22, fumes from materials stored on the upper shelves 28 and 29 could escape into the laboratory if a single door is provided for the entire cabinet 10. However, with the illustrated embodiment, materials can be retrieved from shelves 30–33 through doors 23 and 24 while minimizing the possibility of fumes escaping from shelves 28 and 29, provided door 22 is left closed. In order to further reduce the possibility of noxious fumes escaping from vented laboratory cabinet 10 when items are retrieved therefrom, doors 22–24 are preferably provided with a transparent glazing panel 60 (e.g., glass or plastic) that allows the contents of the cabinet to be viewed without opening the doors, so that it may be possible to see the item which is to be retrieved from the cabinet and only open the appropriate door 22-23 and 24 to retrieve the needed item. However, as an alternative a single door may be used with or without a transparent glazing panel, or multiple doors may be used without glazing panels.

Optionally, as shown in FIG. 3, partitions 62 may be provided to further inhibit vapors from passing from one part of cabinet 10 that is associated with one of doors 22–24 to another part of cabinet 10 associated with another of doors 22–24. This reduces the amount of fumes in one part of cabinet 10 that can escape when a door associated with another part of cabinet 10 is open. In the illustrated embodiment, partitions 62 have a length that is less than the distance from a front surface 54 of vent pipe 44 to an interior surface 56 of doors 22–24 to provide a gap between the rear edge of partition 62 and vent pipe 44, and another gap between the front edge of partition 62 and a respective one of the doors 22–24. Thus, partition 62 inhibits the flow of fumes and vapors from one part of cabinet 10 to another part of cabinet 10, and thereby inhibits escape of fumes and vapors from one part of cabinet 10 when a door associated with anther part of cabinet 10 is open, while still allowing fumes and vapors to freely flow upwardly and around the forward and rearward edges of partition 62 when doors 22–24 are closed to facilitate efficient venting of fumes and vapors from all parts of cabinet 10.

In the illustrated embodiment each of vent openings 50 is located at a height between adjacent shelves or between the top shelf and the top of the cabinet, so that air is continuously drawn across the space above each of the shelves 28–33. The bottom end of vent pipe 44 is provided with a cap sealingly connected thereto to temporarily trap any liquid which might condense from vapors flowing through vent pipe 44.

The upper surface of each of the shelves 28–33 is preferably made of a material that is resistant to a wide variety of chemicals. In accordance with a preferred aspect of the invention, shelves 28–33 are made of a melamine impregnated paper firmly fused to a substrate, such as an industrial grade particle board or medium density fiberboard (MDF). A suitable commercially available product is PANOLAM™ panels, which are available from Domtar Inc.

It will be understood by those who practice the invention and by those skilled in the art the various modifications and improvements may be made to the invention without departing from the spirit of the disclosed concept. The scope of protection afforded is to be determined by the claims and by the breath of interpretation allowed by law, including the doctrine of equivalents.

The invention claimed is:

1. A vented laboratory cabinet comprising:

an interior storage space defined by a plurality of panels and accessible through a closeable door, the cabinet including an exhaust opening;

at least one shelf carried within the cabinet interior; and a vent pipe extending downwardly from the exhaust opening toward a lower part of the cabinet, the vent pipe having at least two vertically spaced apart vent openings for passage of gases from the cabinet into the vent pipe, at least one of said vent openings being located at a height above said shelf and at least one other vent opening being located at a height below said shelf.

2. The cabinet of claim 1, wherein the plurality of panels defining the interior storage space includes a top panel, and wherein the exhaust opening is defined through the top panel.

3. The cabinet of claim 1, including at least two vertically spaced part shelves, and wherein the vent pipe includes a vent opening located at an elevation between said shelves.

4. The cabinet of claim 1, wherein the shelf is slidably mounted in the cabinet.

5. The cabinet of claim 4, wherein the plurality of panels defining the interior storage space includes opposing side walls, and wherein the shelf is slidably mounted in the cabinet on slide rails supported on the opposing side panels, each of the slide rails being supported by a plurality of spacer blocks that are spaced apart from each other to allow gases to flow between side edges of the shelf and the side panels.

6. The cabinet of claim 4, wherein the slidably mounted shelf includes lips that circumscribe the periphery of the shelf to prevent items from falling off the shelf when the shelf is slidably moved outwardly from the cabinet or slidably moved inwardly in the cabinet.

7. The cabinet of claim 1, wherein the length of the shelf from a forward edge thereof to a rearward edge thereof is less than the space between a front surface of the vent pipe and an interior surface of the closeable door so that a gap is defined between the rear edge of the shelf and the vent pipe, and a gap is defined between the forward edge of the shelf and the closeable door, whereby gasses may freely flow between the forward edge of the shelf and the closeable door, and between the rearward edge of the shelf and the vent pipe.

8. The cabinet of claim 1, wherein the interior storage space is accessible through a plurality of closeable doors that each provide access to a different part of the cabinet.

9. The cabinet of claim 8, wherein each door includes a transparent glazing to allow the interior of the cabinet to be viewed with the door closed.

10. The cabinet of claim 1, wherein the closeable door includes a transparent glazing panel that allows the interior of the cabinet to be viewed when the door is closed.

11. The cabinet of claim 1, wherein the shelf is made of a chemical resistant material.

12. A vented laboratory cabinet comprising:

an interior storage space defined by a plurality of panels and accessible through a closeable door, the cabinet including an exhaust opening;

a plurality of vertically spaced apart shelves carried within the cabinet interior, said shelves made of a chemical resistant melamine resin-impregnated paper fused to a substrate; and a vent pipe extending downwardly from the exhaust opening through the interior of the cabinet.

13. The cabinet of claim 12, wherein the substrate is an industrial grade particleboard or a medium density fiberboard.

14. A vented laboratory cabinet comprising:

an interior storage spaced defined by a plurality of walls and at least one closeable door;

at least one shelf carried within the cabinet interior, said shelf having a rearward edge spaced from a rear wall of the cabinet to provide a gap between the shelf and rear wall; and a vent pipe extending vertically downwardly from an exhaust opening in the cabinet and through the gap between the shelf and the rear wall of the cabinet, said vent pipe including at least one vent opening located at a height above the shelf and at least one vent opening located at a height below the shelf.

15. The cabinet of claim 14, wherein the plurality of panels defining the interior storage space includes a top panel, and wherein the exhaust opening is defined through the top panel.

16. The cabinet of claim 14, including at least two vertically spaced part shelves, and wherein the vent pipe includes a vent opening located at an elevation between said shelves.

17. The cabinet of claim 14, wherein the shelf is slidably mounted in the cabinet.

18. The cabinet of claim 17, wherein the plurality of panels defining the interior storage space includes opposing side walls, and wherein the shelf is slidably mounted in the cabinet on slide rails supported on the opposing side panels, each of the slide rails being supported by a plurality of spacer blocks that are spaced apart from each other to allow gases to flow between the side edges of the shelf and the side panels.

19. The cabinet of claim 17, wherein the slidably mounted shelf includes lips that circumscribe the periphery of the shelf to prevent items from falling off the shelf when the shelf is slidably moved outwardly from the cabinet or slidably moved inwardly in the cabinet.

20. The cabinet of claim 14, wherein the length of the shelf from a forward edge thereof to a rearward edge thereof is less than the space between a front surface of the vent pipe and an interior surface of the closeable door so that a gap is defined between the rear edge of each shelf and the vent pipe, and a gap is defined between the forward edge of each shelf and the closeable door, whereby gasses may freely flow between the forward edge of each shelf and the closeable door, and between the rearward edge of each shelf and the vent pipe.

21. The cabinet of claim 14, wherein the door includes a transparent glazing to allow the interior of the cabinet to be viewed with the door closed.

22. The cabinet of claim 14, wherein the shelf is made of a chemical resistant material.

23. A vented laboratory cabinet comprising:

an interior storage space defined by a plurality of walls and at least one closeable door;

a plurality of vertically spaced apart shelves carried within the cabinet interior, the shelves made of a chemical resistant melamine resin-impregnated paper fused to a substrate; and a vent pipe extruding downwardly from an exhaust opening in the cabinet.

24. The cabinet of claim 23, wherein the substrate is an industrial grade particleboard or a medium density fiberboard.

* * * * *

UNITED STATES PATENT AND TRADEMARK OFFICE

CERTIFICATE OF CORRECTION

PATENT NO. : 6,302,786 B1
DATED : October 16, 2001
INVENTOR(S) : Thomas E. Bauer et al.

It is certified that error appears in the above-identified patent and that said Letters Patent is hereby corrected as shown below:

Column 2,
Line 37, "a" should be -- an --.

Column 4,
Line 14, "anther" should be -- another --.
Line 62, "part" should be -- apart --.

Signed and Sealed this

Twenty-third Day of April, 2002

*Attest:*

*Attesting Officer*

JAMES E. ROGAN
*Director of the United States Patent and Trademark Office*